US007836917B1

(12) United States Patent
Osborne

(10) Patent No.: US 7,836,917 B1
(45) Date of Patent: Nov. 23, 2010

(54) WEAVING CONNECTORS FOR THREE DIMENSIONAL TEXTILE PRODUCTS

(75) Inventor: Eva Faye Osborne, New Smyrna Beach, FL (US)

(73) Assignee: Paradox LLC, Edgewater, FL (US)

( * ) Notice: Subject to any disclaimer, the term of this patent is extended or adjusted under 35 U.S.C. 154(b) by 0 days.

(21) Appl. No.: 12/591,372

(22) Filed: Nov. 18, 2009

(51) Int. Cl.
*D03D 13/00* (2006.01)
*D03D 11/00* (2006.01)
*D03D 41/00* (2006.01)
*D03D 23/00* (2006.01)

(52) U.S. Cl. ..... 139/11; 139/383 R; 139/DIG. 1

(58) Field of Classification Search ..... 139/383 R, 139/11, 2.5, DIG. 1
See application file for complete search history.

(56) References Cited

U.S. PATENT DOCUMENTS 5,085,252 A * 2/1992 Mohamed et al. ..... 139/22
5,224,519 A * 7/1993 Farley ..... 139/11
5,435,352 A * 7/1995 Yamamoto et al. ..... 139/11
5,449,025 A * 9/1995 Weinberg ..... 139/11
5,465,760 A * 11/1995 Mohamed et al. ..... 139/11
6,129,122 A * 10/2000 Bilisik ..... 139/11
6,186,185 B1 * 2/2001 Khokar ..... 139/1 R
6,315,007 B1 * 11/2001 Mohamed et al. ..... 139/11
6,338,367 B1 * 1/2002 Khokar ..... 139/11
6,431,222 B1 * 8/2002 Khokar ..... 139/383 R
6,470,916 B1 * 10/2002 Uchida et al. ..... 139/11
6,712,099 B2 * 3/2004 Schmidt et al. ..... 139/383 R
6,742,547 B2 * 6/2004 Bryn et al. ..... 139/383 R
6,886,603 B2 * 5/2005 Uchida et al. ..... 139/11
6,892,766 B2 * 5/2005 Bryn et al. ..... 139/11
7,073,538 B2 * 7/2006 Bhatnagar et al. ..... 139/383 R
7,077,167 B2 * 7/2006 Nayfeh et al. ..... 139/11
7,628,179 B2 * 12/2009 Mohamed ..... 139/11
2006/0249217 A1 * 11/2006 Nayfeh et al. ..... 139/11
2007/0107796 A1 * 5/2007 Nayfeh et al. ..... 139/11

* cited by examiner

*Primary Examiner*—Bobby H Muromoto, Jr.

(57) ABSTRACT

Creating textile product by utilizing a three dimensional Cartesian coordinate system as the infrastructure for weaving simultaneous independent fabric layers in conjunction with weaving connectors between and among the layers.

10 Claims, 12 Drawing Sheets

WEAVING CONNECTORS FOR THREE DIMENSIONAL TEXTILE PRODUCTS

BACKGROUND OF THE INVENTION

In general, fabrics are woven in two dimensions. The warp and fill interlace in a single x-y plane resulting in a fabric that has various decorative and surface characteristics. These two dimensional fabrics can also use double weaves in the fill and warp direction to add texture and design features to the fabric surface. Pile fabrics such as terry and velvet can be produced by weaving two layers simultaneously with the pile yarn connecting the layers. More complex face to face fabrics are exhibited in U.S. Pat. No. 6,186,186 to Debaes et al (2001). Construction on Jacquard machines using multiple sheds to create carpeting and velvet structures is described in U.S. Pat. No. 6,073,663 to Dewispelaere et al (1999).

Three dimensional fabrics and textile articles use double weaves to create tubes and tunnels along the fill and warp direction. Using the double weaves for the formation of tubes and tunnels with shuttle looms allows for a seamless shape in the machine direction. This process will result in articles large enough to produce tee shirt type garments. Products designed with electronic and optic components benefit from this continuous weaving characteristic of shuttle looms. These products are described in U.S. Pat. No. 6,145,551 to Jayaraman (2000). Shuttle-less looms are used to produce a woven type of joining in three dimensions. These are illustrated in U.S. Pat. No. 7,069,961 to Sollars (2006) for pressurized cushions by creating large open spaces between woven joined perimeters. Another technique for creating three dimensional shaped fabrics binding two layers from single connectors is shown in U.S. Pat. No. 4,671,471 to Jonas. A more architectural approach is achieved through fill-tow and cross shaped fill insertion to multiple layers for composite materials in aeronautics as described in U.S. Pat. No. 6,712,099 to Schmidt et al (2004).

Each of these techniques exhibit advantages in unique textile products. They provide complex weave structures specifically designed to meet the performance needs of the individual article. However, further benefit can be realized by envisioning the patterning on the loom as a three dimensional Cartesian coordinate system (x, y, z) rather than limiting the product to the bi-coordinate planes (x, y). Further advantages can be expanded by increasing the number of interlacings (picks and ends) on the loom set up. Pick and end counts that have a low number of interlacings (400 per inch, 20 ends×20 picks) would not provide adequate pixel sites to create 3D product. However, moderate end counts of 9600 ends can accommodate up to 100 picks per inch per layer. This would expand to 71,000 possible pixel sites per inch for 4 level multi-layered patterning. Silk loom set ups are even higher with 20,000 ends and up to 300 picks per inch. This construct results in 100,000 interlacing sites (pixels) per inch. By weaving four layers the number of possible interlacings (pixels) increases to 400,000 per inch. Connecting the multiple layers through an expanded double weave type of process can produce three dimensional product on the loom. Such an invention would mechanize the manufacture of typical cut and sew operations for woven textile product.

It is the intent of the present invention to provide a weaving process that will form interconnected weave structures that use non vertically aligned warp ends in successive layers of simultaneously woven fabric plans. The warp and weft yarn interlacings created between and among the non-aligned shifted fabric plane arrays, will be referred to as "warp yarn and weft yarn connectors" herein. The combination use of these connectors and fabric layers will enable textile design to create textile product that is full to semi-full fashioned on the loom.

SUMMARY OF THE INVENTION

The object of this invention is to provide a process for producing woven textile product that can extend the width of the fabric to a width greater than the loom width, create enveloping structures, bracket multiple layers, construct stepped structures, produce multiple angles through straight and curved mitering, exhibit face-side to backside differentiation, and form three dimensional curves by simultaneously weaving distinct multiple layers of fabric on a loom which are attached with various connecting weave constructs throughout the fabric layers length and width. The woven article results in full fashioned or semi full fashioned product by manipulating the geometry of the tunnels, tubes, and shapes from inside out and creating internal and external folding operations.

By weaving these articles with different fiber contents, yarn structures, weave designs and finishing operations the final performance characteristics of the textile product can be enhanced. Two examples are performance products utilizing elastomeric yarns for garment shaping and utilizing double beams for thermal composite product.

The present invention process of combining the weaving connectors to form articles made of fabric can use any type of loom and patterning machine such as water-jet, air-jet, rapier, shuttle, dobby and jacquard. However, the full embodiment of the process is gleaned with electronic jacquard machines and electronic looms.

The interlacings of the fill and warp yarns can be viewed as three dimensional Cartesian coordinates. Successive and multiple planes of the x and y direction are connected in the z direction.

The z coordinates can be place among and between layers during weaving. The products are created by creating the facets (x, y planes) of a geometric shape and joining them together with the woven connectors (z). As in basic drafting, the z coordinates (bend here) connect the planes to form the facets of the product in a three dimensional geometry. Since fabric formation and fabric joining are both incorporated on the loom the product can exhibit improved fabric joining performance characteristics and reduce processing. Weaving in 3 dimensions on multi-layers of fabric can automate finished textile product with existing weave equipment.

Additional advantages and objects of the invention will be set forth in part in the description, which follows, and in part will be obvious from the description, or may be learned by practice for the invention. It is to be understood that both the examples set forth in the foregoing general description and the detailed description of the preferred embodiments are exemplary and explanatory only, and are not to be viewed as in any way restricting the scope of the invention as set forth in the claims.

DETAILED DESCRIPTION OF THE ILLUSTRATIVE EMBODIMENTS

Figure 1:
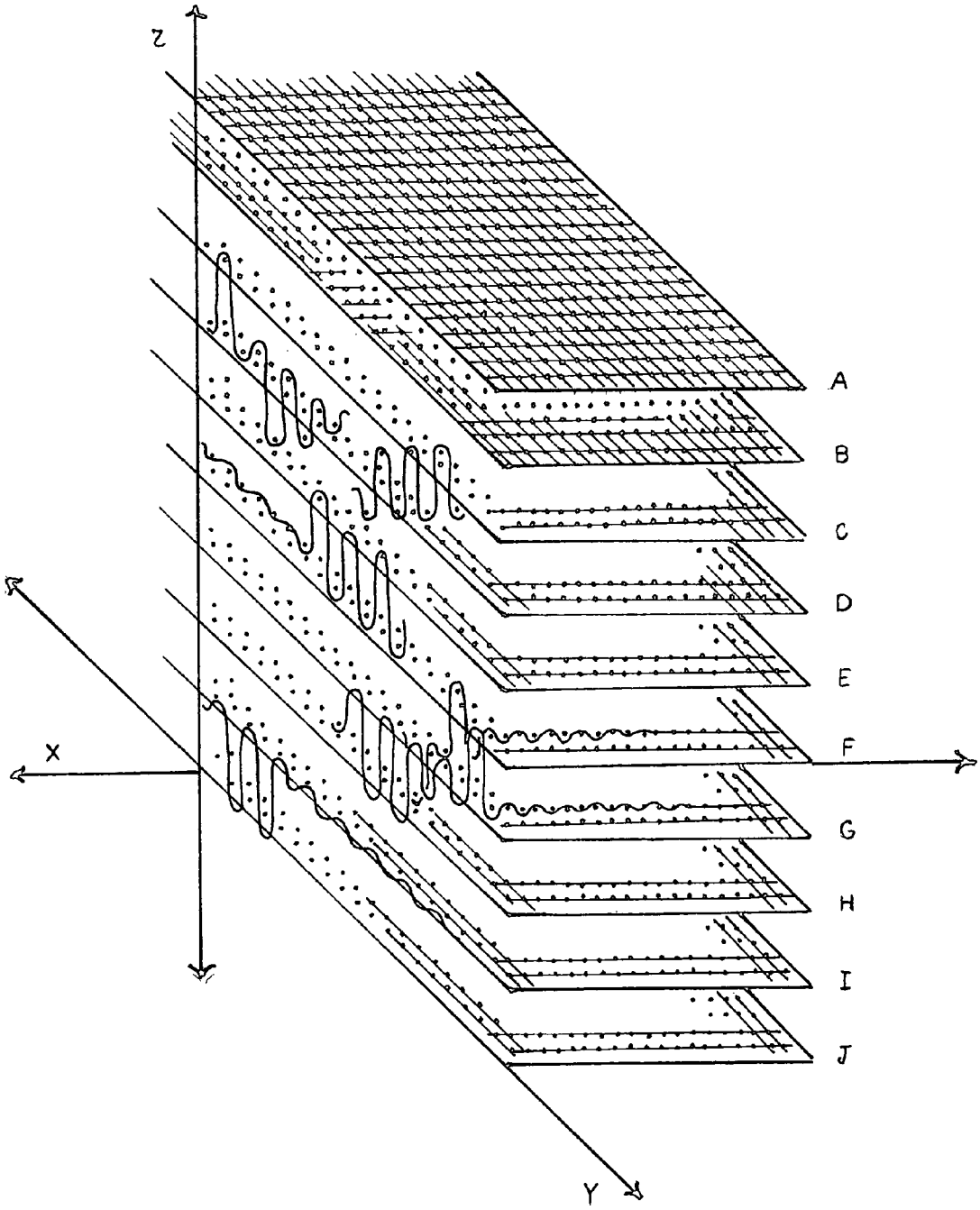
FIG. 1 View of 3D Cartesian coordinate system

Shown in the drawing of FIG. 1 is the overall concept of connecting multiple fabric layers from the perspective of a 3 dimensional Cartesian Coordinate System (X, Y, Z). The top layer, A, exhibits a plain weave with a point at each interlacing. It is at these points that a 3 dimensional Cartesian coordinate (or pixel) can be visualized. These pixels are points of possible interlacing sites (B through J). The connections are formed from interlacing between and among the warp yarns and fill yarns. The shape, direction, dependency and independency of each layer is only restricted by the number of layers, end count, and the warp count. These three variables establish the number of interlacings (pixels) possible.

Figure 2:
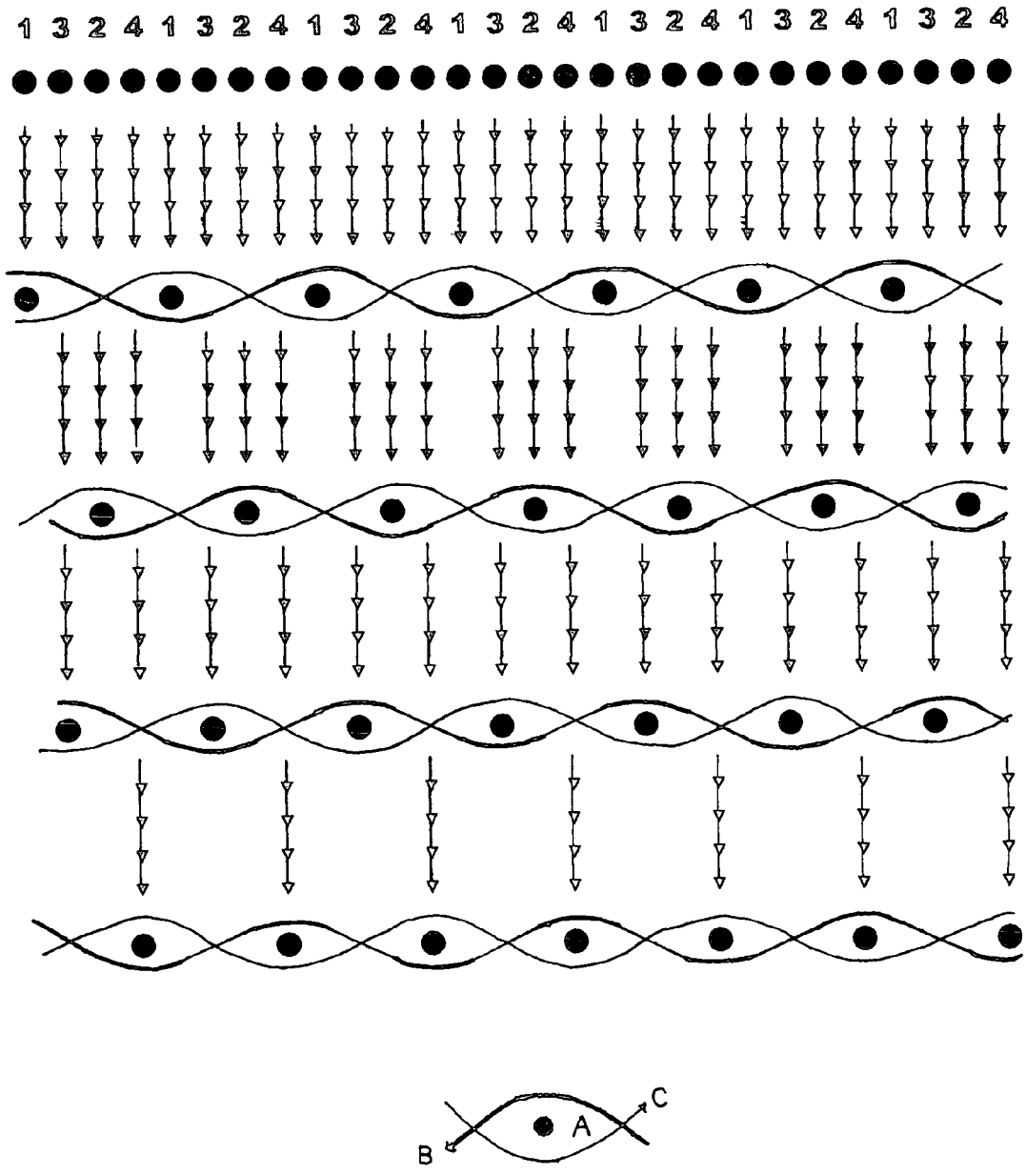
FIG. 2 Layering warp ends into four layers using three dimensional Cartesian Coordinates FIG. 3 Spliced Formation FIG. 4 Bracketed Formation FIG. 5 Enveloped Formation FIG. 6 Stepped Formation FIG. 7 Fanned Formation FIG. 8 Mitered Formation FIG. 9 Face-side to backside Layer Floats FIG. 10 Inside out Tunnels FIG. 11 Inside out Envelopes FIG. 12 Inside out tunnels with folding operations

Shown in the drawing of FIG. 2 is a cross-section of a preferred structure for layering a plain woven fabric into four layers from one warp. The relative position of the warp yarns exhibits a shifted array. Each warp yarn is designated to a distinct fabric layer that is unaligned vertically among all fabric layers. The four layers are used for example only. The numbers of layers are determined by the performance requirements of the final textile product. The plain weave is used to simplify the illustration as a concept. The weave type is non restrictive. Yarn type is dictated by performance characteristics. Though the embodiment of the invention is not restricted by fiber or yarn type, the preferred substrate utilizes elastomeric yarns in the fill. The warp count is generally mid range or higher, at or about 9600, but it is not restricted to end counts. The cross section of the warp is illustrated with each successive cross section designated to a layer through nomenclature 1, 2, 3, 4. The enlarged cross section of the warp end A is interlaced with two successive fill yarns B & C. This drawing of an interlacing is used throughout the detailed description for weaving connectors illustrated in FIG. 2 through FIG. 9. In FIG. 2, each layer is related to the corresponding warp ends 1, 2, 3, 4 as well as the interlacing fill yarns. The illustration shows that by weaving alternating warp ends as separate patterns in the fill direction independent layers are created.

Figure 3:
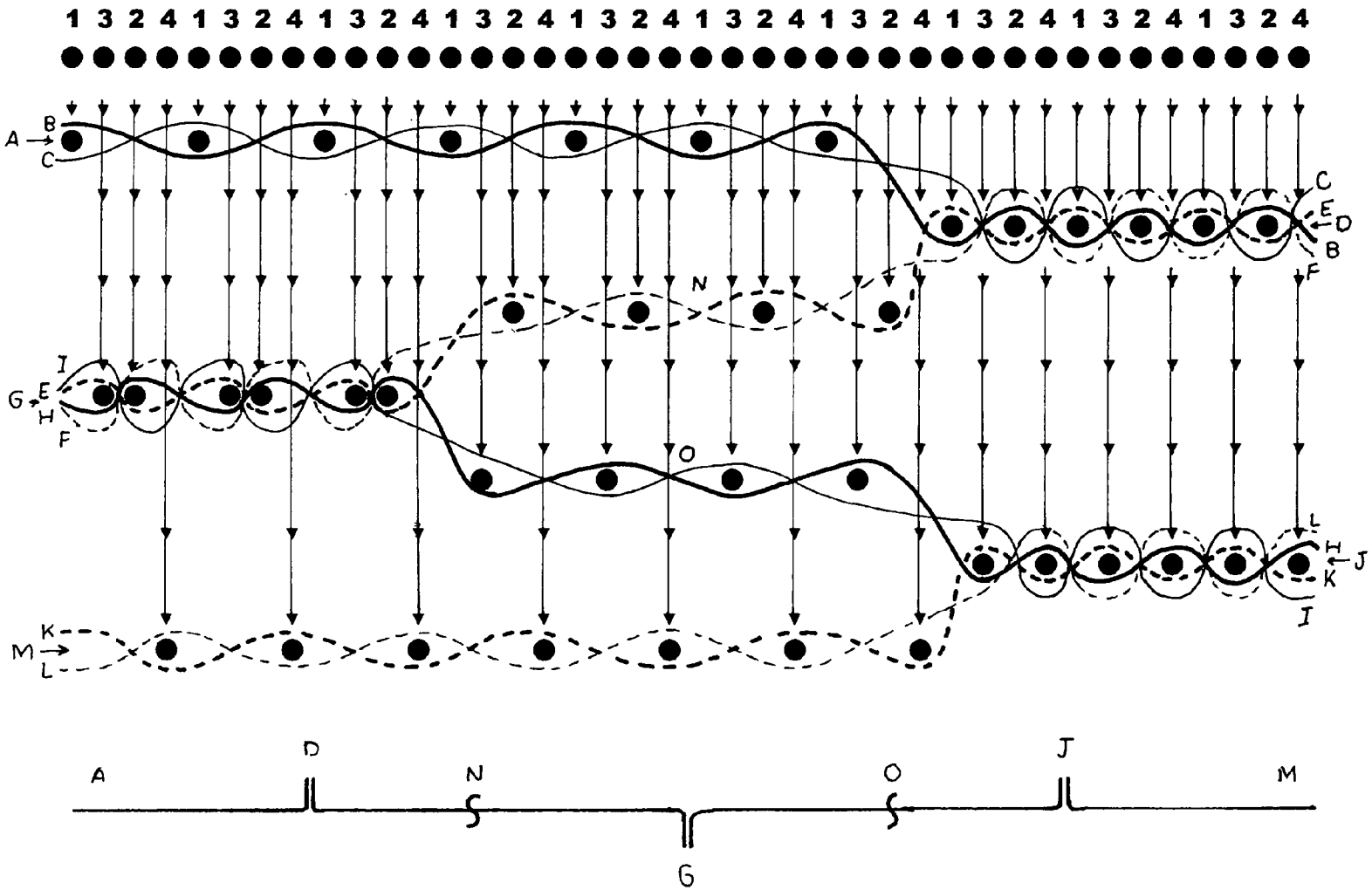

FIG. 3 shows the type of weaving connector which can extend the width of the product to a width greater than the warp width. In this case layers A and N are woven together at selvage (D) on the left side of the loom. Layers N and O are woven together at the selvage (G) on the right side of the loom, Layers O and M are woven together at the selvage (J) on the left side of the loom. When the fabric is opened full width, shown at the bottom of the drawing, (A, D, N, G, O, J, M) the width is equal to the number of fabric layers times the warp width; for example 4 layers×60"=240" final fabric width. Increasing fabric widths at the selvedge can reduce or eliminate sewn seams for textile product that has extremely large surface areas. It also provides joining strengths equal to the fabric tensile strength. High tensile strength joining would be advantageous to products such as: sails, geo-textiles, screening, parachutes, aeronautics and compression products with high modulus. Additional benefit can be realized with textile products utilizing cut resistant fibers such as the para-aramids, whereby the cutting operations and sewing are eliminated or reduced.

Figure 4:
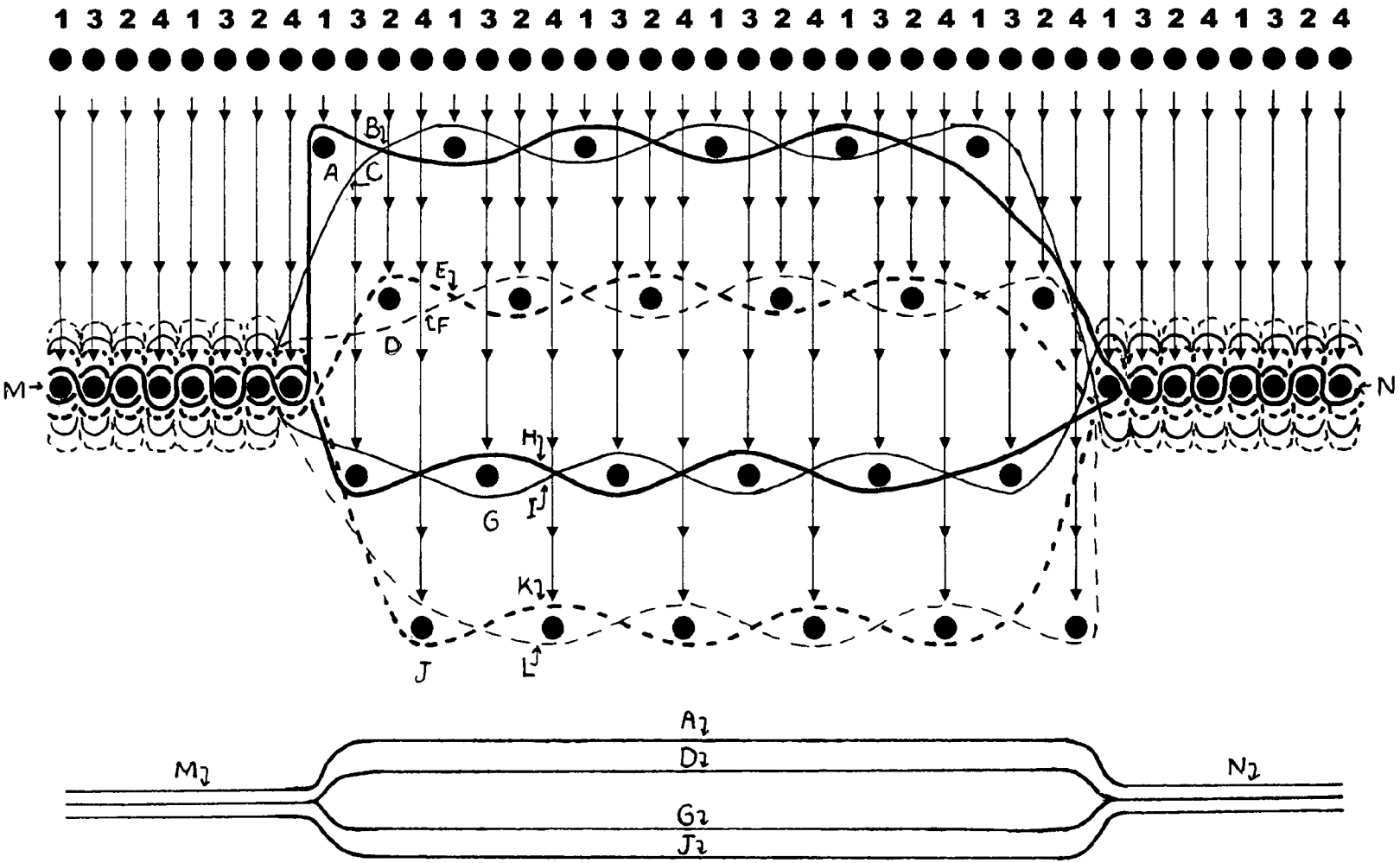

FIG. 4 shows the weaving connector that brackets the layers together. In this case layers A, D, G, J are woven together on both selvages (M, N). The fill yarns (B/C, E/F, H/I, K/L) for the four layers are shown to move from a compacted form at the selvages to a more open structure in the plain weaves of each layer. The applications of this embodiment of the invention have been utilized to create lined products or separate composite product or body shapes for garment construction. The fabric joining can occur at the selvage or at any point within the width of the fabric. The cross-section of the fabric layers is viewed at the bottom of the drawing.

Figure 5:
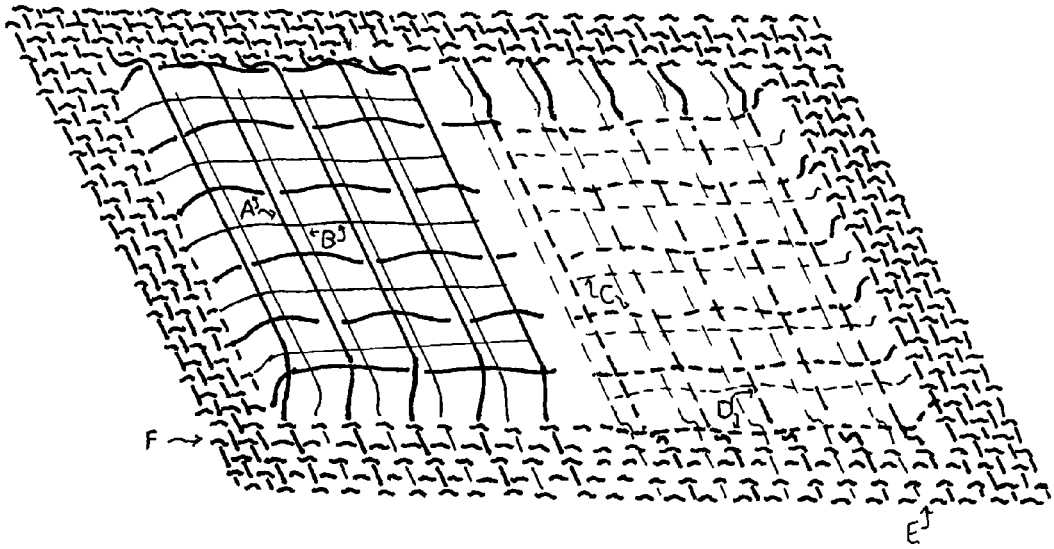
Figure 5:
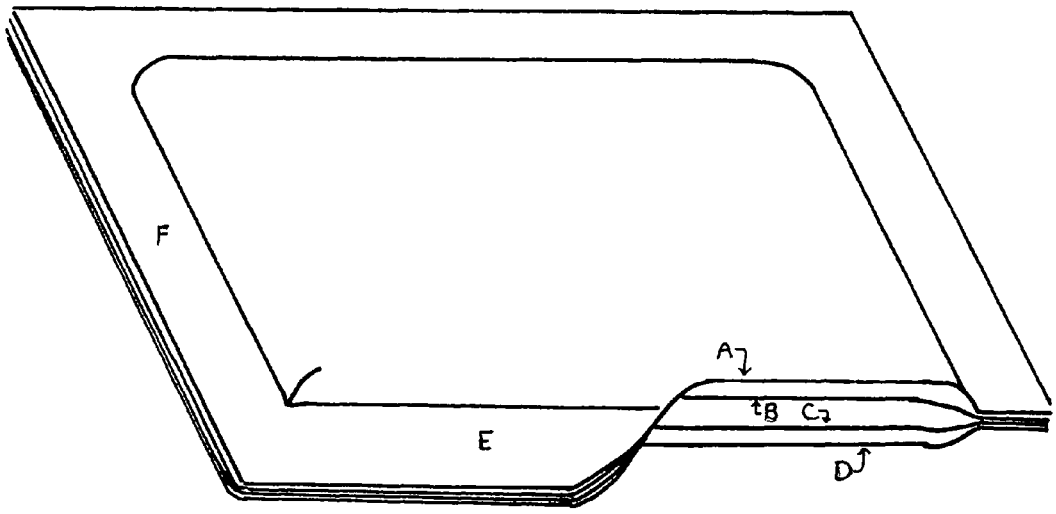

FIG. 5 shows two types of weaving connectors; bracketing (F) and fill joining (E). Woven together these connectors create multi ply pocketing, pouches and envelope structures through independent fabric layers (A, B, C, D). The open structures can be located anywhere within the warp or fill direction and can be parallel to the warp and fill yarns or at any angle or with any curve. Openings for access into the structures can be accommodated for tubing, airways, water ways, and reversing the outside layer. These structures can be woven across the warp or fill or pulled inside out at any layer. The resulting fabric construction is viewed at the bottom of the drawing.

Figure 6:
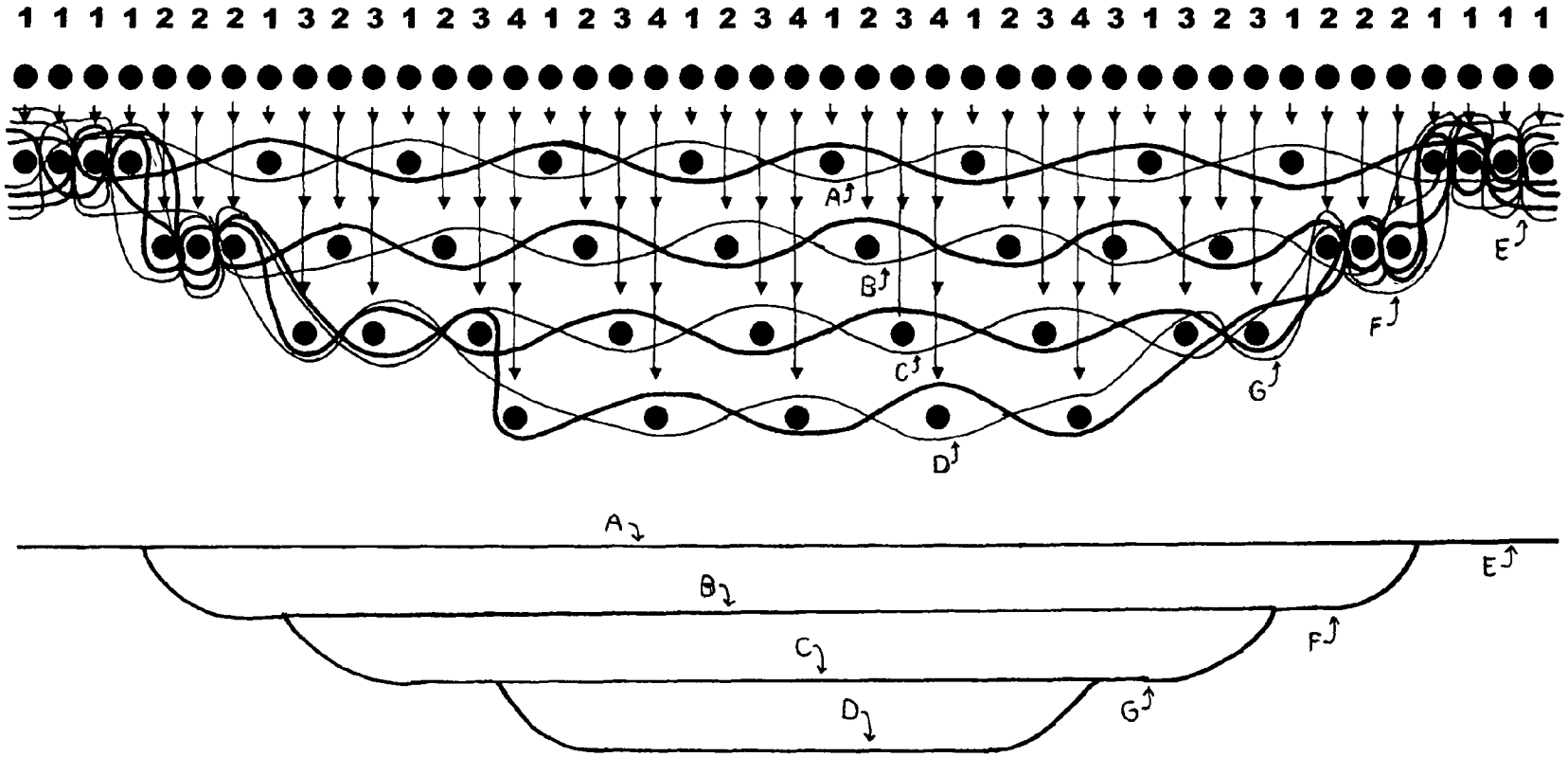

FIG. 6 exhibits a stepped construction. This connector weaves successive layers together in larger and smaller openings for each successive combination of layers (A through D). This particular illustration exhibits a pyramidal structure. The geometry of the open areas is not restricted to the layers, the number of the layers or the position of the shape within the layered structure. The purpose is to establish a process whereby the connecting sites of the geometric shapes are available for 3 dimensional product from 2 dimensional patterning in the X, Y, and Z planes on the loom. The open structures can be located anywhere within the warp or fill direction and can be parallel to the warp and fill yarns or at any angle or with any curve. Openings for access into the structures can be accommodated for tubing, airways, water ways, and reversing the outside layer. These structures can be woven across the warp or fill or pulled inside out at any layer. The concept of successive pocketing is viewed at the bottom of the drawing.

Figure 7:
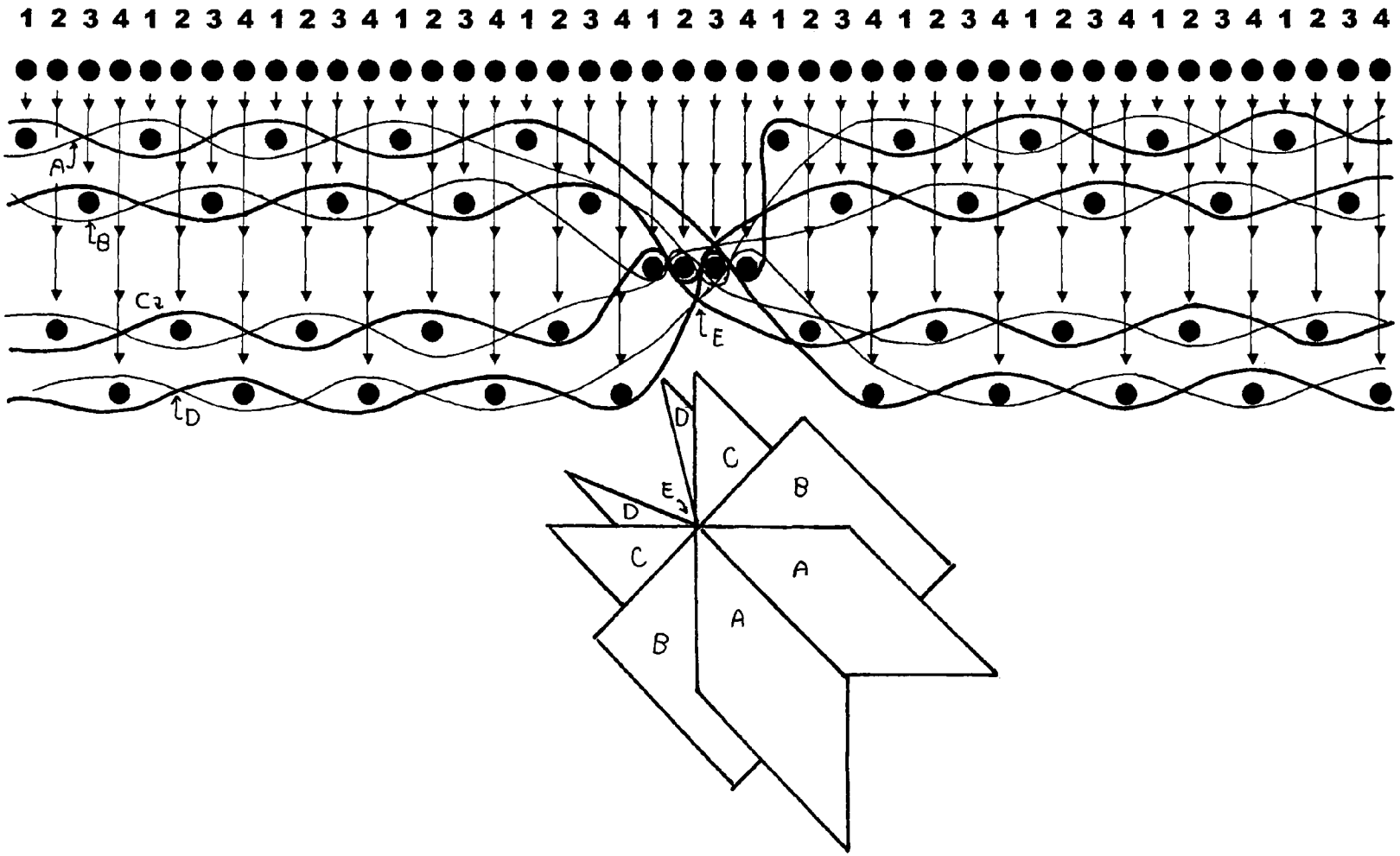

FIG. 7 exhibits a central connector (E) such that the layers (A through D) are fanned out into multiple planes. Wider connectors with internal tunnels can offer support as well as an access for other media such as optics, electricity, metal rods etc. The fanning allows for multiple direction for product patterning.

Figure 8:
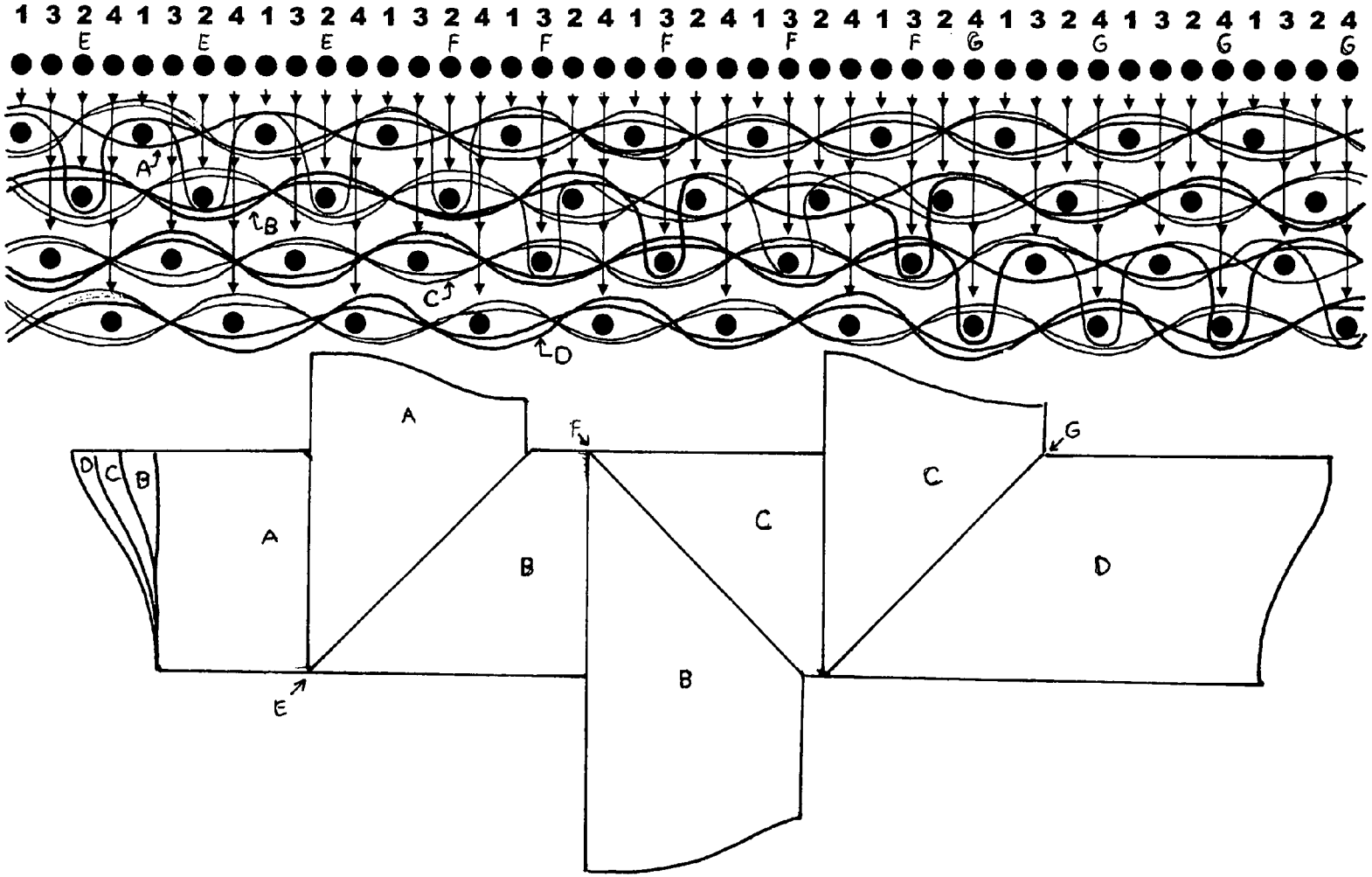

FIG. 8 shows straight and curved mitering. These layers are connected with adjacent layers of fabric woven such that the layers can form a joint that positions the layers in opposing planes. These planes are used for mirror imaging in the garment patterning and forming connecting joints for tubular formation.

Figure 9:
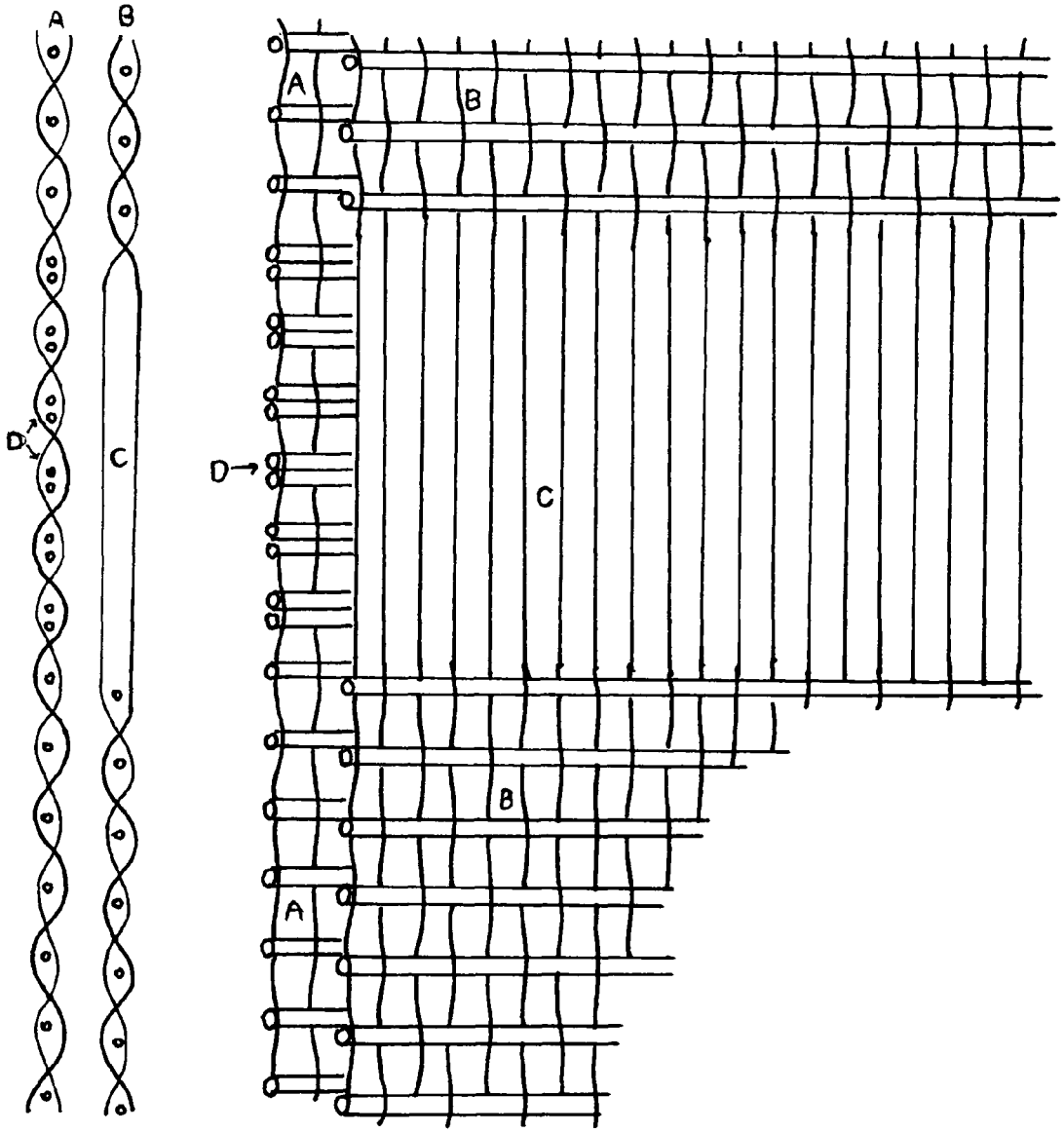

FIG. 9 illustrates the weave used when exposing single warp yarns on the top layer of a two layer construct. The purpose of the floats is to reduce the amount of yarn exposed for thermal or ultrasonic bonding. The floats are welded or melted back to the 1:1 weave construction which leaves an opening for access between the layers. The perpendicular yarns to the floats are woven into the adjacent layer to prohibit raveling and provide additional support at the opening. As those skilled in the art of weaving understand, the contour, size, direction, position and shape of the float opening are not restricted.

Figure 10:
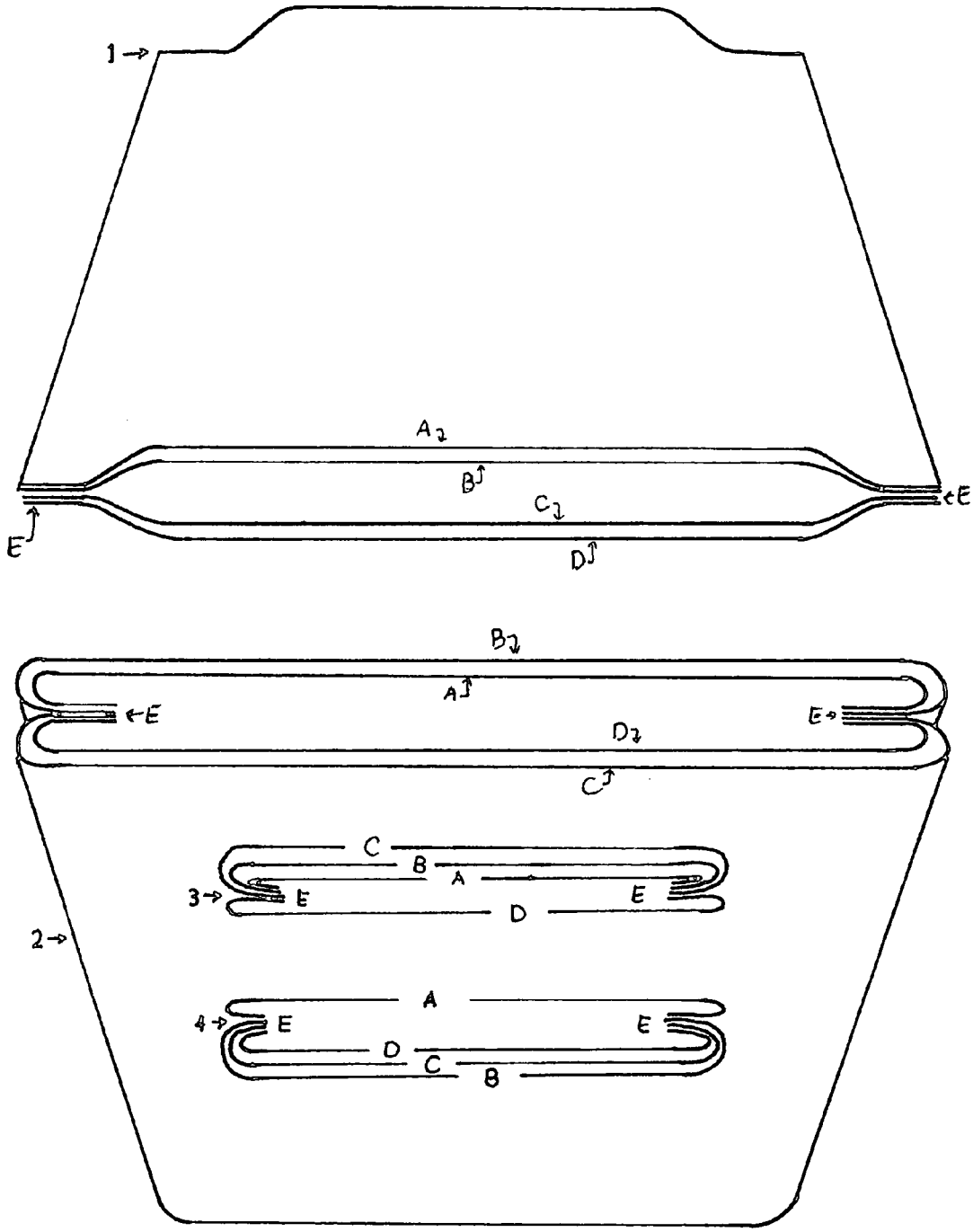

FIG. 10 illustrates a four layer construct (A, B, C, D) that has all four layers joined at the outside edges (1). The four layers can be turned inside out between any of the layers (B, C, D) to expose different fabric layers (2, 3, 4). The position of the layers (A, B, C, D) are repositioned with the joined edges on the inside of the construct and smooth joints on the two outside edges of the construct.

Figure 11:
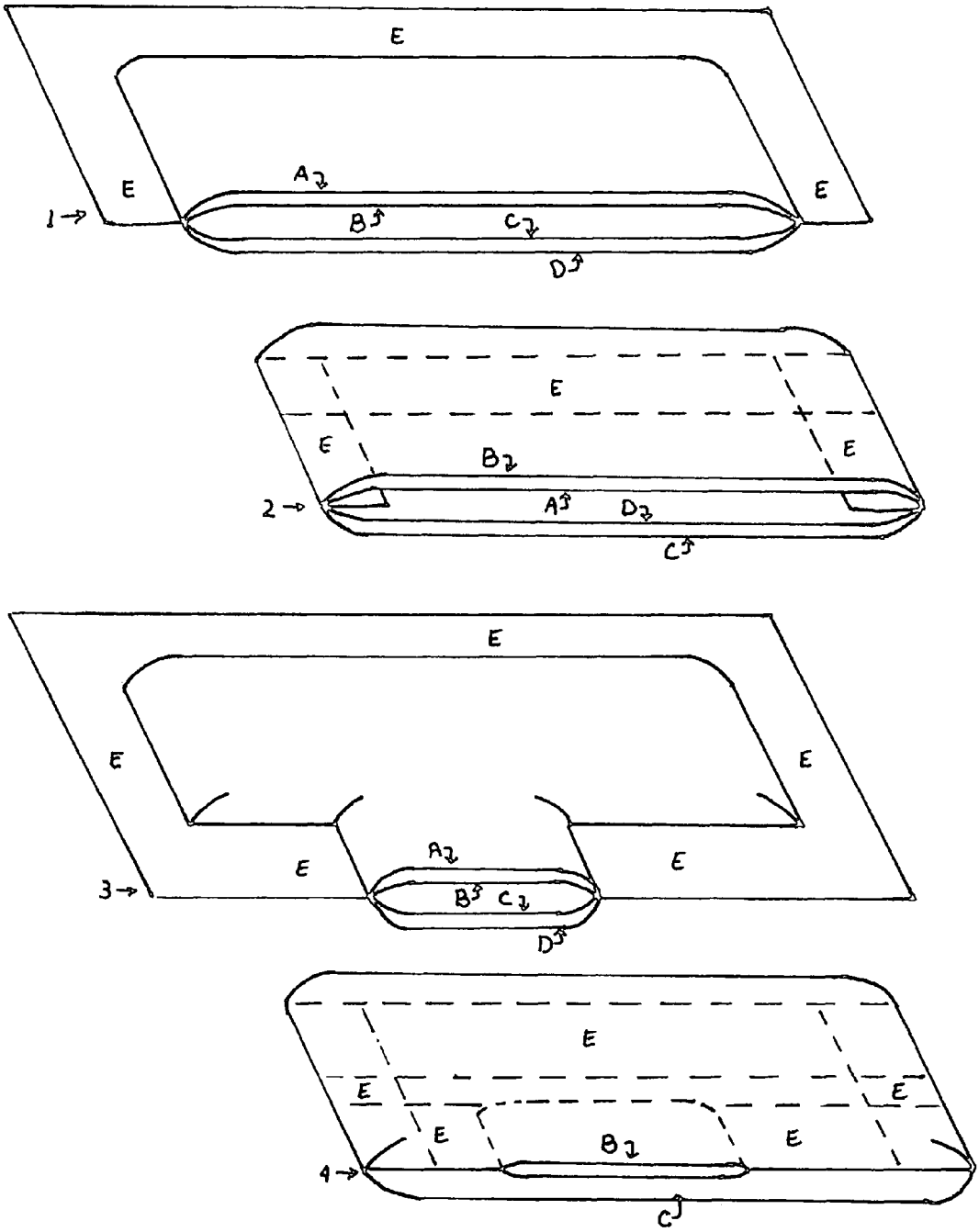

FIG. 11 represents the three sided and four sided, four layered, construct turned inside out (1, 3). The loom state position of 1 shows joining on the outside layers and one joint across the warp ends. The joined edges, E, are on the outside of the construct. The four layers can be turned inside out between any of the layers. The position of the layers (A, B, C, D) are now repositioned with the joined edges on the inside of the construct. This results in smooth edges on three outside edges of the construct (2). Additionally, fully enclosed constructs (3) can be formed by extending the joining to the fourth side of the perimeter and leaving an opening for turning. The same number of exposed sides of the layers are now available with this four sided enclosure construct as with the three sided enclosure.

Figure 12:
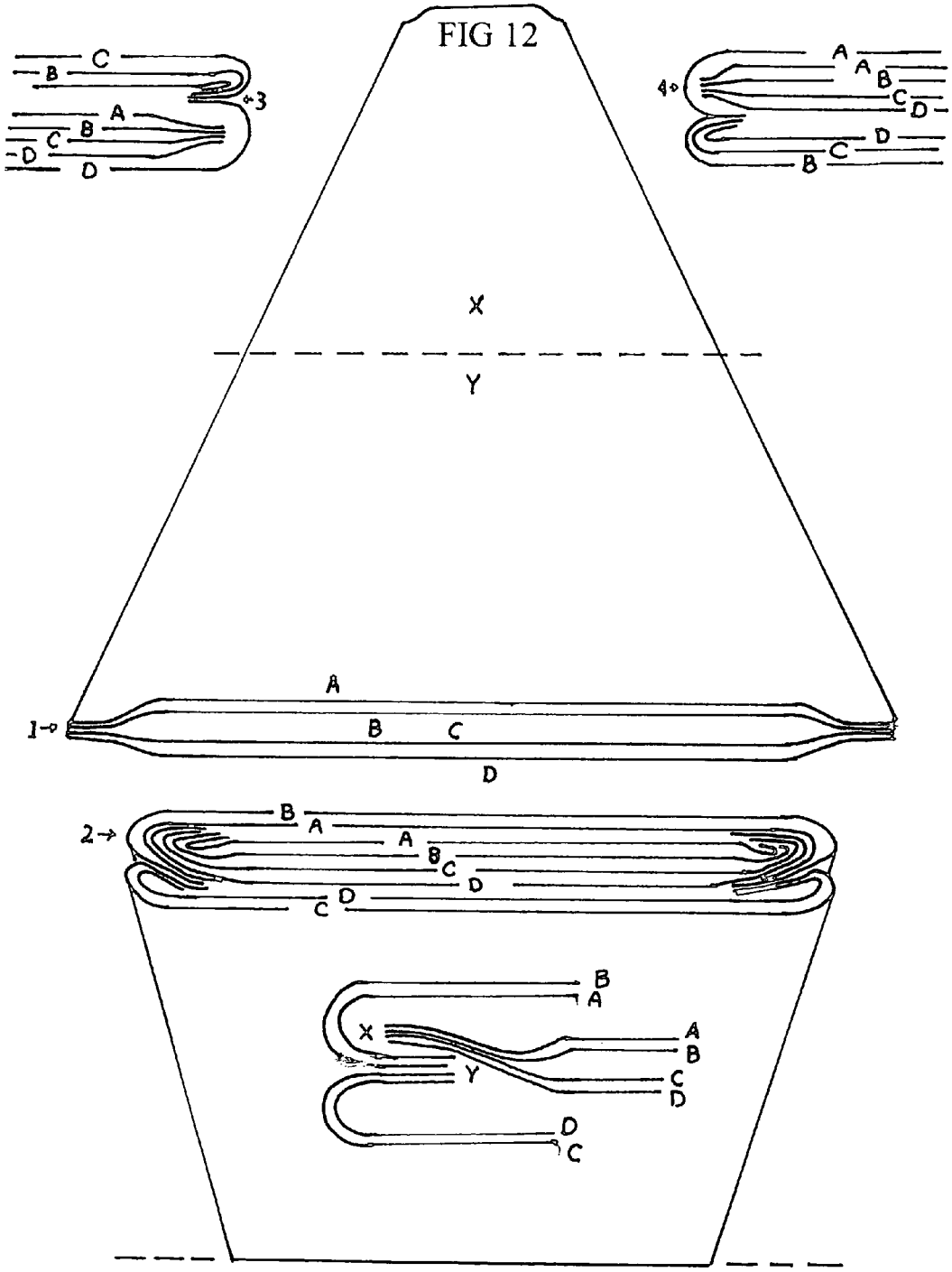

FIG. 12 illustrates the folding operation (1) for creating smooth joints on the inside (X) and outside (Y) of a four layer construct (2). The folds can result in multiple placements of the layers among the outside (2, 3, 4). The folding operation increases the number of layers for products that contain multiple fabric types for composite uses in textile product.

What is claimed is:

1. A process for weaving textile product utilizing independent layers of fabrics woven with a plurality of warp yarn and fill yarn connectors created with a plurality of warp yarns positioned in vertically shifted arrays comprising the steps of:

a. weaving at least two mutually adjacent fabric layers formed in the x, y plane of a 3 dimensional coordinate system, and b. weaving of mutually adjacent fabric layers simultaneously on the loom, and c. placing each successive adjacent fabric layer in the z direction of the 3 dimensional coordinate system, and d. shifting vertically, each successive fabric layer into a non-aligned array, and e. interlacing a plurality of fill and warp yarns alternately between and among the adjacent fabrics layers, whereby a connection is formed between and among the fabric layers.

2. A process according to claim 1 wherein the connection occurs by interlacing a plurality of fill and warp yarns between and among the adjacent layers at the right and left sides of a shape that is open at opposing ends of the perimeter.

3. A process according to claim 1 wherein the connection occurs by interlacing a plurality of fill and warp yarns alternately between and among the adjacent layers along the machine direction and cross machine direction to form enclosed spaces on consecutive sides.

4. A process according to claim 1 wherein the connection occurs by interlacing a plurality of fill and warp yarns alternately between and among successive adjacent layers whereby each successive layer is bound in an increasing or decreasing stepwise process such that the layers form successive pockets between the adjacent layers.

5. A process according to claim 1 wherein the connection occurs by interlacing a plurality of fill and warp yarns among all layers along a line of weaving in a uni-direction in the machine or cross machine direction such that the joining creates a site whereby each section of a layer can extend into a different plane.

6. A process according to claim 1 wherein the connection occurs by interlacing a plurality of fill and warp yarns between and among successive adjacent layers within the fabric width and forming a plurality of tangent angles between and among the layers which exhibit mitered sections permitting the joined layers to extend into different planes on any independent angle.

7. A process according to claim 1 wherein the connection occurs by interlacing a plurality of fill and warp yarns between and among successive adjacent layers wherein at least two mutually adjacent layers are connected by interlacing the fill yarns alternately between and among the warp yarns within the machine direction and cross direction whereby the outside of one layer exposes only fill or warp yarns as floats and the opposing direction of yarn interlaces into the adjacent layer.

8. A process according to claim 1 wherein the connection occurs by interlacing a plurality of fill and warp yarns alternately between and among the adjacent layers, and at the selvedge to form a multiple of the fabric width.

9. A process according to claim 1 further comprising the step of folding adjacent fabric layers into complex layered product.

10. A process according to claim 1 further comprising the step of turning the product inside to outside forming the final complex layered product.

* * * * *